US005967759A

United States Patent [19]

Jurado

[11] Patent Number: 5,967,759

[45] Date of Patent: Oct. 19, 1999

[54] BASEMENT FLASH FLOOD CONTROL SYSTEM

[76] Inventor: Reynaldo Jurado, 7017 N. Kenton St., Lincolnwood, Ill. 60646

[21] Appl. No.: 08/916,070

[22] Filed: Aug. 21, 1997

[51] Int. Cl.[6] ..... F04B 49/00

[52] U.S. Cl. ..... 417/36; 417/53

[58] Field of Search ..... 417/36, 40, 2, 417/3, 4, 5, 423.5, 53

[56] References Cited

U.S. PATENT DOCUMENTS

| | | | |
|---|---|---|---|
| 2,816,574 | 12/1957 | Bots | 417/593 |
| 3,814,544 | 6/1974 | Roberts et al. | 417/40 |
| 3,963,376 | 6/1976 | Miskin | 417/40 |
| 4,180,094 | 12/1979 | Viragh | 137/362 |
| 4,456,432 | 6/1984 | Mannino | 417/2 |
| 5,628,281 | 5/1997 | Kelley | 119/262 |

*Primary Examiner*—Charles G. Freay
*Assistant Examiner*—Robert Z. Evora
*Attorney, Agent, or Firm*—Paul H. Gallagher

[57] ABSTRACT

A main pump unit which includes a main pump and a standby pump in a tank is placed on the basement floor, not in a sump. The tank is sealed with the floor level drain, preventing reverse sewer water from flowing onto the floor. The pump (main) turns on before the sewer water from overflowing the appliances, such as toilet and bathtub. The system includes an arrangement for using the customary fresh water supply for testing the pump. It also includes means for ventilating the tank to the exterior.

9 Claims, 2 Drawing Sheets

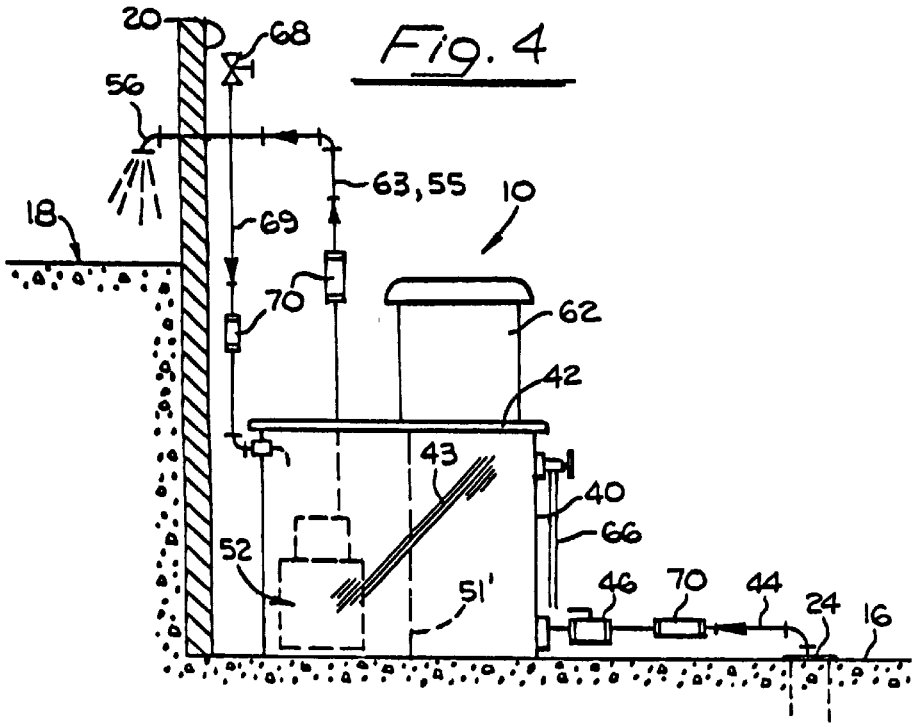
Fig. 4
Fig. 5
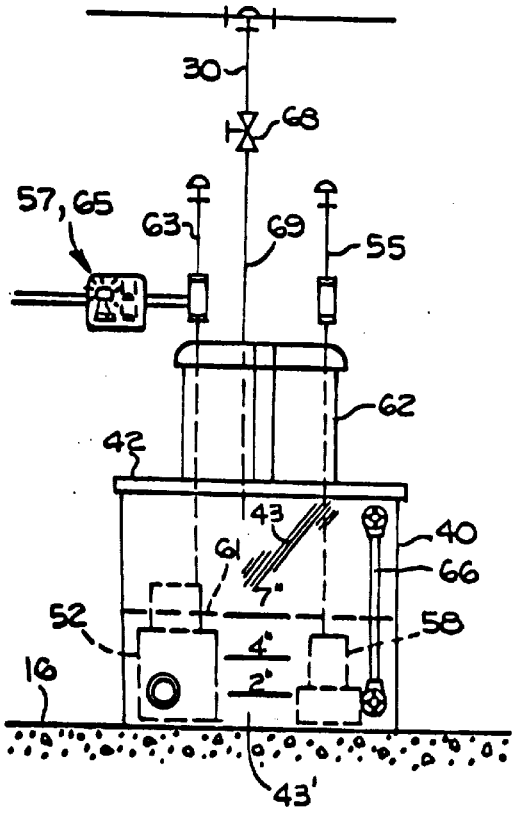
Fig. 6
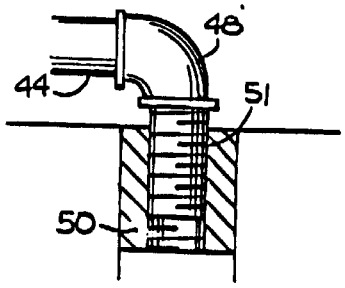
Fig. 7
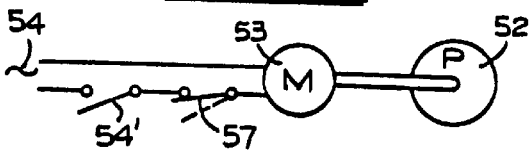
Fig. 8
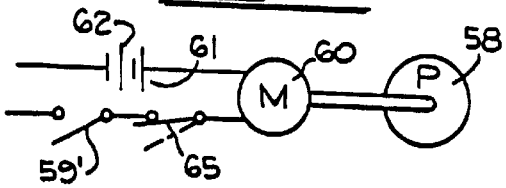

BASEMENT FLASH FLOOD CONTROL SYSTEM

SUMMARY OF THE INVENTION

The invention resides in the field of controlling water in the basement in the case of a flash flood.

The invention includes a system, that is, apparatus and method of operation.

The apparatus is used in a basement having a floor below the surrounding ground level, and a drain in the floor, and other drainage outlets, leading to a common or public sewer.

Such a basement often has a toilet and a bathtub or a sink on the floor, below the surrounding ground level.

In sudden downpours, the sewage backed up in the sewer system, and in such situations heretofore, the back sewage flowed through the toilets and bathtubs onto the basement floor, and contaminated the floor and produced obnoxious odors.

OBJECTS OF THE INVENTION

A main object of the invention is to provide a control system for overcoming the foregoing problems, having the following features and advantages:

1. It includes a main unit, or pump unit, that connects directly with the floor drain and prevents the back flow of sewage from flowing onto the basement floor.
2. More specifically, it pumps the back-up sewer water directly from the floor drain and thereby prevents it from flowing onto the floor from that drain, and thereby prevents it from flowing back through the toilet and sink and onto the floor.
3. The main unit rests directly on the floor of the basement and need not be positioned in a sump, thus eliminating the requirement for installing the main unit below the basement floor.
4. The main unit includes a main pump and a standby pump, and means for testing the pumps, by use of the usual inlet fresh water supply, at various times, as desired.
5. The apparatus is extremely simple and inexpensive, both in its original fabrication, and its installation for use.

BRIEF DESCRIPTIONS OF THE INDIVIDUAL FIGURES OF THE DRAWINGS

FIG. 4 is a vertical side view of the main unit installed in a basement.

FIG. 5 is a vertical front view taken from the right of FIG. 4.

FIG. 6 is a detail illustration of the water line connection in the floor drain.

FIG. 7 is a fragmentary view of the main pump and electrical circuit therefor.

FIG. 8 is a fragmentary view of the standby pump and the electrical circuit therefor.

DETAILED DESCRIPTION OF THE DRAWINGS

Figure 1:
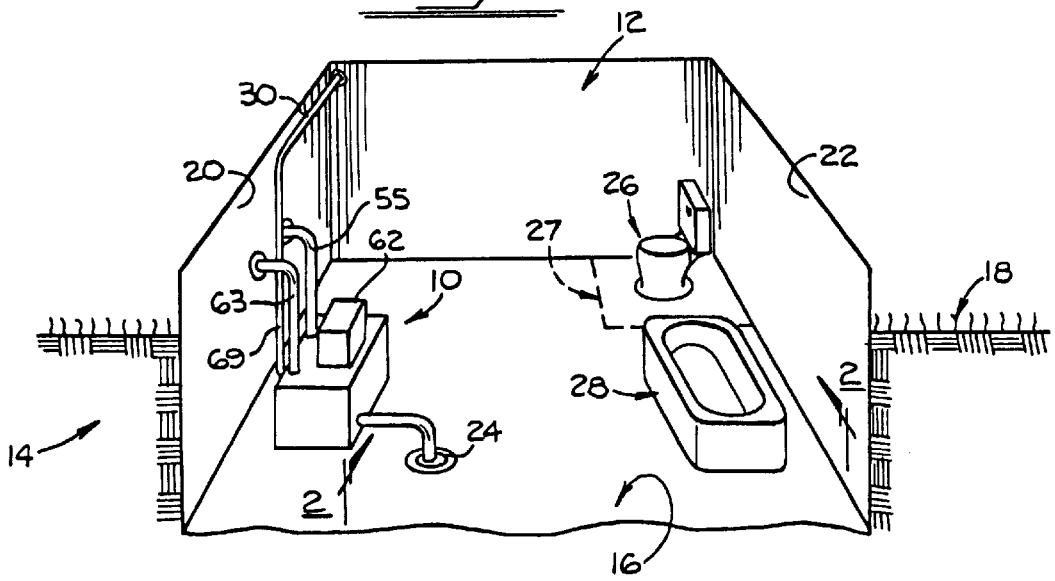
FIG. 1 is a diagrammatic perspective illustration showing the apparatus of the invention in place in a basement, together with other appliances.

FIG. 1 shows, in diagrammatic form, a unit or component 10 constituting substantially the apparatus of the invention, installed in a basement 12 formed in the ground 14. The basement has a floor 16 which is below the level 18 of the surrounding ground. The unit 10 may be referred to as a pump unit or main unit.

For convenience, reference is first made to the basement and its construction, and fixtures or instrumentalities normally contained therein. The basement has a left wall 20 and a right wall 22, and the floor is provided with a drain outlet or opening 24 which may be of known construction. The pump unit 10 is adapted for connection with such a known construction.

As indicated, the unit 10 is adapted for use where other fixtures are present, such as a toilet 26 in a enclosing closet 27 shown diagrammatically, and a bathtub 28. Another fixture often found in a basement is a sink. It will be noted that these fixtures are above the basement floor, and below the ground level, and their connection with the drain and relationship to the pump unit will be described hereinbelow.

The pump unit 10 is placed in a convenient location such as adjacent the drain opening 24, and in the present arrangement is disposed adjacent the wall 20 while the other fixtures may be in any convenient location. The various drains run into a common outside drain pipe or sewer 34. The basement is also provided with a customary fresh water system 30.

Figure 2:
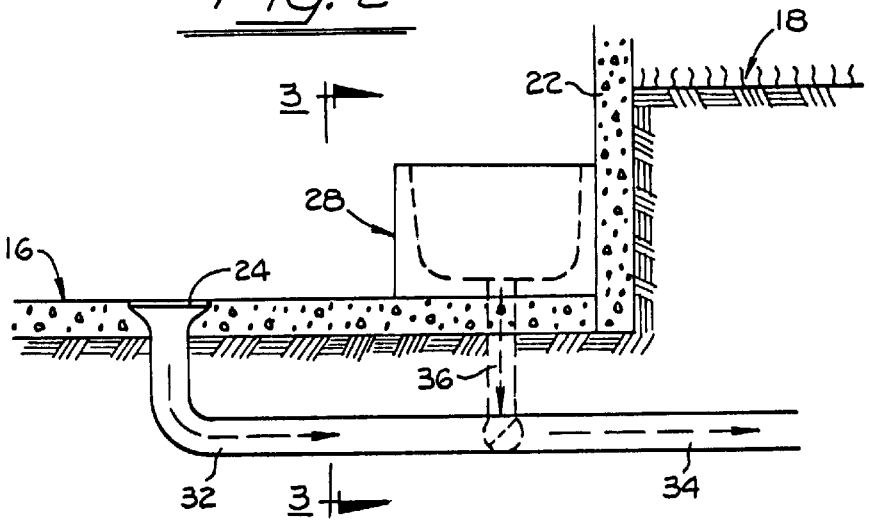
FIG. 2 is a view oriented according to the line 2—2 of FIG. 1.
Figure 3:
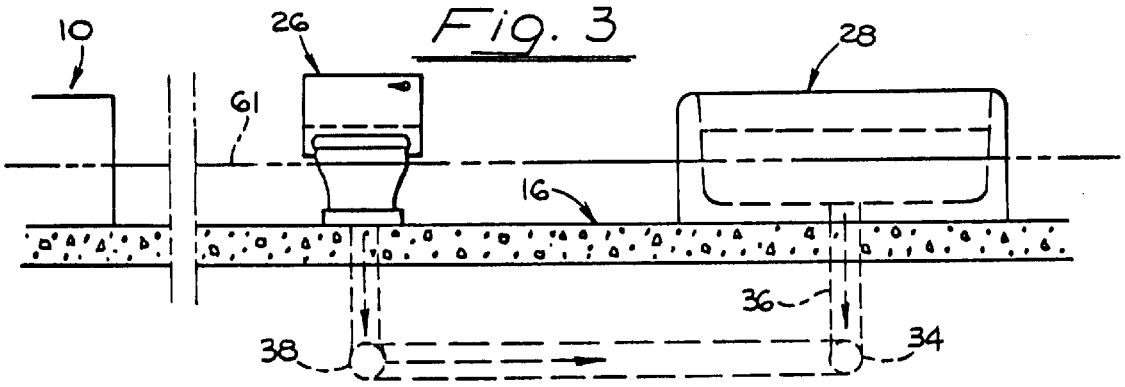
FIG. 3 is a cross-section view oriented according to line 3—3 of FIG. 2, and including the pump unit.

Attention is directed to FIGS. 2 and 3 which show an outlet drain pipe 32 leading from the drain opening 24 into the exterior sewer 34. The bathtub 28 has a drain pipe 36 and the toilet 26 (FIG. 3) has a drain pipe 38, both leading to the sewer.

In the case of flash floods, the flood waters suddenly flow in reverse direction, from the sewer through the various drain pipes and into the toilet and bathtub and, as has happened heretofore, overflow onto the basement floor. In the present case, comparison is made with a standpipe which is ordinarily used in connection with the floor drain only, but is not used in the present installation.

Attention is directed to FIGS. 4 and 5 which show the construction and full contents of the unit 10 and its connection with the drain in the floor. For convenience certain water lines are shown diagrammatically in single-line form. The unit includes a casing 40, in the form of a box having an open top covered by a removable cover 42, forming a tank. The casing 40 is entirely closed, except for the open top, and receives the sewer water therein in its operation. This casing is preferably constructed of translucent material as indicated at 43, to form a water level gauge, referred to again below. Water level markings 43' are also provided. The unit 10 includes a water line 44 leading from the floor drain 24 into the casing, this water line containing a manually actuated shut off valve 46. The line has a sealed connection indicated at 48 in FIG. 6, the floor drain having a suitable fitting, such as an internally threaded sleeve 50 as a part of its permanent construction, and the water line has an externally threaded connector member 51 threaded therein. The valve 46 is normally open, and upon the sewage backing up in the floor drain, it flows through the line 44 into the casing 40. A screen 51' (FIG. 4) is placed in the tank 40, to prevent trash from entering and damaging the pumps identified below. This screen is removed periodically for cleaning out the trash collected.

Mounted in the casing 40 in a suitable and known manner is a main pump 52, resting on the bottom of the casing. This pump is driven by a 120V AC motor 53 (FIG. 7) powered by the community AC power line as indicated at 54.

When the flood waters reach a certain predetermined set level in the casing, such as for example 5", the main pump 52 is energized in a known manner as by a suitable control switch, such as a float switch 54' (FIG. 7) and the pump thereupon pumps the water from the casing through an exhaust line 63 having an outlet terminal 56 (FIG. 4) on the exterior of the building and above the ground level, the sewage flowing onto the ground. A hand control NC switch 57 (FIGS. 5, 7) is provided for disabling the pump motor for use in test purposes as referred to below.

This exhaust pump continues to operate as long as the sewage flows into the casing, until the water level therein drops to a predetermined level according to the internal law of operation of the pump and control, which in this case is preferably approximately 2".

Also mounted in the casing 40 is a standby or backup pump 58, this pump in itself also being of known kind, and as shown in FIG. 8, it is driven by a 12V DC motor 60, operated by a battery 62. This standby pump also operates when the level of the water in the casing reaches a certain predetermined height 61 (FIG. 5), but at a height greater than that controlling the main pump 52. This level may be for example 7". If the main pump should fail, and the water level continues to rise, the standby pump turns on at the level indicated and pumps out the sewage, through an outlet line 55 which is preferably a line separate from the line 63, to the exterior of the basement and onto the ground. The motor is controlled by a control switch 59' (FIG. 8) which may be a float switch. A hand control disabling NC switch 65 (FIGS. 5, 8) is included in the DC circuit for testing purposes, as referred to below. The battery 62 may be conveniently mounted on the tank 10, as shown in (FIGS. 4, 5).

The hand control switches 57, 65 may be positioned at any convenient location as shown in FIG. 5.

FIG. 3 shows the water level line 61 identified in connection with FIG. 5, extended across the basement and into the toilet and bathtub which is below the level of flooding from the toilet and bathtub.

The casing 40, instead of being made of translucent material, may be made of metal, for example, and in the latter case a common water level gauge 66 may be utilized.

In the case of an extremely great flood condition, in which the main pump would be incapable of pumping all of the sewage, the level in the casing would thereupon continue to rise, and the standby pump would turn on also and act as a supplementary pump.

The inlet fresh water line 30, having a shut-off valve 68, has an extension line 69 leading into the casing 40, terminating preferably at the upper region of the casing, above the expected levels of the sewage.

The pipe lines handling the overflow water and sewage may be of PVC, having suitable connections, including unions indicated at 70, while the fresh water pipes 30 may be of the usual black pipe.

An important feature of the invention is the provision of a method for testing the exhaust pumps. As a first step (FIGS. 4, 5), for testing the main pump 52 (FIGS. 4, 7), the disabling switch 65 of the standby pump 58 (FIG. 8) is opened, the valve 46 (FIG. 4) is closed and the valve 68 opened for directing the fresh water into the casing 40. The water level 61 in the casing may be observed through the casing wall at 43, or in the gauge 66, and when it rises to about 5", as indicated above, the main pump begins operating and pumping water out. As the water level thereupon goes down, the pump will stop operating when the water level recedes to the level mentioned, namely, about 2", and the test for this main pump is complete.

To test the standby pump 58, the main pump is shut off by the switch 57 (FIGS. 5, 6) and the switch 65 is closed. The fresh water line 30 is then turned on and when the level rises to about 7", as indicated, the standby pump is automatically turned on by the float switch 59', and as the water level thereupon again goes down, the standby pump will stop operating when the level reaches the level indicated, about 2". The test for the standby pump is thereupon complete.

The casing 40 with the lines 44, 55, 63, is a substantially complete unit in itself, in the sense of putting it in position. To install the apparatus, the unit 10 is simply placed directly on the floor, and the drain line 44 connected, and the water lines connected to the exterior, and the fresh water inlet line, connected. No sump is required.

There is no need for special drainage. The floor drain 34 remains sealed, relative to the space in the basement, and is connected with the tank and through the lines 63, 65 to the exterior. There is consequently no residue of the flood on the basement floor.

I claim:

1. Basement flood control apparatus for use in a building having a basement in the ground with a floor below the ground level, and a drainage system having a plurality of inlets leading from the basement to the exterior of the building, at least one of the inlets being a floor drain, wherein the water in the drainage system flows in reverse through the floor drain in the floor when the water reaches an effective height above the floor, said apparatus comprising, a pump unit separate from the floor and being entirely disconnected from the floor and the building except through water lines, the pump resting on the floor and including a tank, a first water line having a first end detachably and sealingly connected with the floor drain and a second end sealed to and communicating with the tank, a main pump in the tank having a first electrical driving means, a first outlet water line operably connected with the main pump and leading to the exterior of the building, and first control means operable in response to water in the tank reaching a first predetermined height for energizing the main pump for pumping the water out of the tank to the exterior of the building.

2. Apparatus according to claim 1, installed in the basement in which the sewer system includes a plurality of additional inlets, above the floor level, and wherein backup sewage is capable of flowing into the basement through said additional inlets.

3. Apparatus according to claim 2, wherein, the building has a fresh water line system, the pump unit is connected with the fresh water line system so that fresh water can be directed from the fresh water line system into the tank, the apparatus includes an electrical shut-off means for each of the first and second electrical driving means, individually, and shut-off valve means is incorporated in said fresh water line system.

4. Apparatus according to claim 1 wherein, a standby pump is included in the tank, said standby pump has a second electrical driving means, a second outlet water line leading from the standby pump to the exterior of the building, and second control means operable in response to water in the tank reaching a second predetermined height for energizing the standby pump for pumping the water out of the tank to the exterior of the building, the control means being so operable at respectively different ones of said first and second predetermined heights.

5. Apparatus according to claim 4 wherein, said tank is of translucent material to enable a user to visualize the level of the water in the tank, and the tank includes water level indicators disposed on the tank for the user to observe and compare the water level.

6. A method of preventing flooding in a basement of a building, wherein the basement has a floor in the ground below the ground level, the building has a drainage system with a floor drain, and in the event of an excessive rain, water backs up in the drainage system through the floor drain, the method comprising, providing a tank on and detached from the basement floor, and a fluid line leading from the floor drain to the tank with a seal therebetween, to prevent escape of water from the floor drain onto the basement floor, providing a fluid pump in the tank, providing means for driving the pump, providing an outlet fluid line from the tank to the exterior of the building, and further providing control means for actuating the driving means in response to a first predetermined level of water in the tank.

7. A method according to claim 6 wherein, the basement has a plurality of additional inserts above said floor drain leading to said drainage system.

8. A method according to claim 6 and comprising the additional steps, utilizing a supply of fresh water and introducing it into the tank to predetermined levels, in sequence relative to the two pumps and thereby testing the effectiveness of the pumps individually and successively.

9. A method according to claim 8 and including the further steps, utilizing a portion of the fresh water system for providing drainage from the tank to the exterior of the building.

* * * * *